US008857444B2

(12) United States Patent
Chuan

(10) Patent No.: US 8,857,444 B2
(45) Date of Patent: Oct. 14, 2014

(54) BI-DIRECTIONAL MULTIPLE-LAYER PULL-IN CIGAR HOLDER

(76) Inventor: Chin-Chung Chuan, Taipei (TW)

( * ) Notice: Subject to any disclaimer, the term of this patent is extended or adjusted under 35 U.S.C. 154(b) by 849 days.

(21) Appl. No.: 13/089,295

(22) Filed: Apr. 18, 2011

(65) Prior Publication Data

US 2012/0261276 A1 Oct. 18, 2012

(51) Int. Cl.
*A24F 1/28* (2006.01)
*A24F 15/20* (2006.01)
*B65D 85/12* (2006.01)

(52) U.S. Cl.
CPC ..... *A24F 15/20* (2013.01); *B65D 85/12* (2013.01)
USPC ..... 131/191; 131/192; 131/175; 131/178; 131/187; 131/185

(58) Field of Classification Search
CPC ..... A24F 15/00; A24F 15/10; A24F 15/20; A24F 15/18; B65D 85/12
USPC ..... 131/187, 191, 175, 178, 185, 192
See application file for complete search history.

(56) References Cited

U.S. PATENT DOCUMENTS

2009/0217933 A1* 9/2009 Chen ..... 131/185
2010/0043809 A1* 2/2010 Magnon ..... 131/178

* cited by examiner

*Primary Examiner* — Richard Crispino
*Assistant Examiner* — Dionne Walls Mayes
(74) *Attorney, Agent, or Firm* — Banger Shia

(57) ABSTRACT

A bi-directional multiple-layer pull-in cigar holder comprises a receiving body mounted on extension tubes which are adapted for adjusting the length of the holder, such that the cigar holder has an extension structure without affecting its appearance, improving the appearance integrity. In addition, with the arrangement of the big-area elastic retaining rings, a right resistance can be offered, improving the assembly convenience while reducing the assembly cost.

8 Claims, 16 Drawing Sheets

BI-DIRECTIONAL MULTIPLE-LAYER PULL-IN CIGAR HOLDER

BACKGROUND OF THE INVENTION

1. Field of the Invention

The present invention relates to a cigar product, and more particularly to a bi-directional multiple-layer pull-in cigar holder.

2. Description of the Prior Art

Referring to FIG. 1, a conventional cigar holder 10 comprises a first tube 11 and a second tube 12 that are mounted on both ends of a receiving tube 13. The first tube 11 and the second tube 12 can extend and retract relative to the receiving tube 13. Each of two opposite ends of the receiving tube 13 is provided with an engaging portion 14 consisting of two half-circle plate 141. Each of the half-circle plates 141 is formed on an inner surface thereof with a protrusion 142 to be engaged in a through hole in the receiving tube 13. Each of the first tube 11 and the second tube 12 is provided with a bushing ring 15 at an end thereof for limiting the disengagement of the respective tubes 11, 12. However, the respective half-circle plates 141 of the engaging portion 14 are difficult to assemble, thus increasing the assembly time as well as the production cost.

Additionally, since the first tube 11 and the second tube 12 are mounted on the receiving tube 13, there are seams on the cigar holder 10, which will affect the appearance integrity of the cigar holder.

The present invention has arisen to mitigate and/or obviate the afore-described disadvantages.

SUMMARY OF THE INVENTION

The primary objective of the present invention is to provide a bi-directional multiple-layer pull-in cigar holder the length of which can be adjusted, increasing the applicability without affecting the appearance integrity.

To achieve the above objective, a bi-directional multiple-layer pull-in cigar holder in accordance with the present invention comprises:

two extension tubes;

at least two circular bases, a first end of each of the two circular bases being connected to a first end of each of the two circular bases, and a second end of each of the two circular bases being formed with plural through holes;

at least two elastic retaining rings being C-shaped elastic plates, each of the elastic retaining rings including plural protruding portions on an inner surface thereof, the elastic retaining rings being disposed on the respective circular bases, the protruding portions of the elastic retaining rings being engaged in the through holes of the ring grooves;

a receiving body being in the form of a hollow tube, the two extension tubes being received in the receiving body, the two circular bases being located adjacent to each other, a second end of each of the extension tubes extending out of each of two opposite ends of the receiving body;

a bottom storage unit being screwed to the second end of a first one of the extension tubes;

a medium connecting element being in the form of a ring and including a first inner threaded portion and a second inner threaded portion on both ends thereof, the medium connecting element being screwed on a second one of the two extension tube through the first inner threaded portion; and a lighter includes an outer threaded portion on an outer surface thereof, the lighter being screwed into the inner threaded portion of the medium connecting element through the outer threaded portion.

Since the receiving body is mounted outside the two extension tubes, the extension tubes which are used to adjust the length are hid in the receiving body, achieve the objective of length adjustment without affecting the appearance integrity. In addition, the big-area elastic retaining rings can further improve the assembly convenience and reduce the assembly cost.

DETAILED DESCRIPTION OF THE PREFERRED EMBODIMENTS

Figure 1:
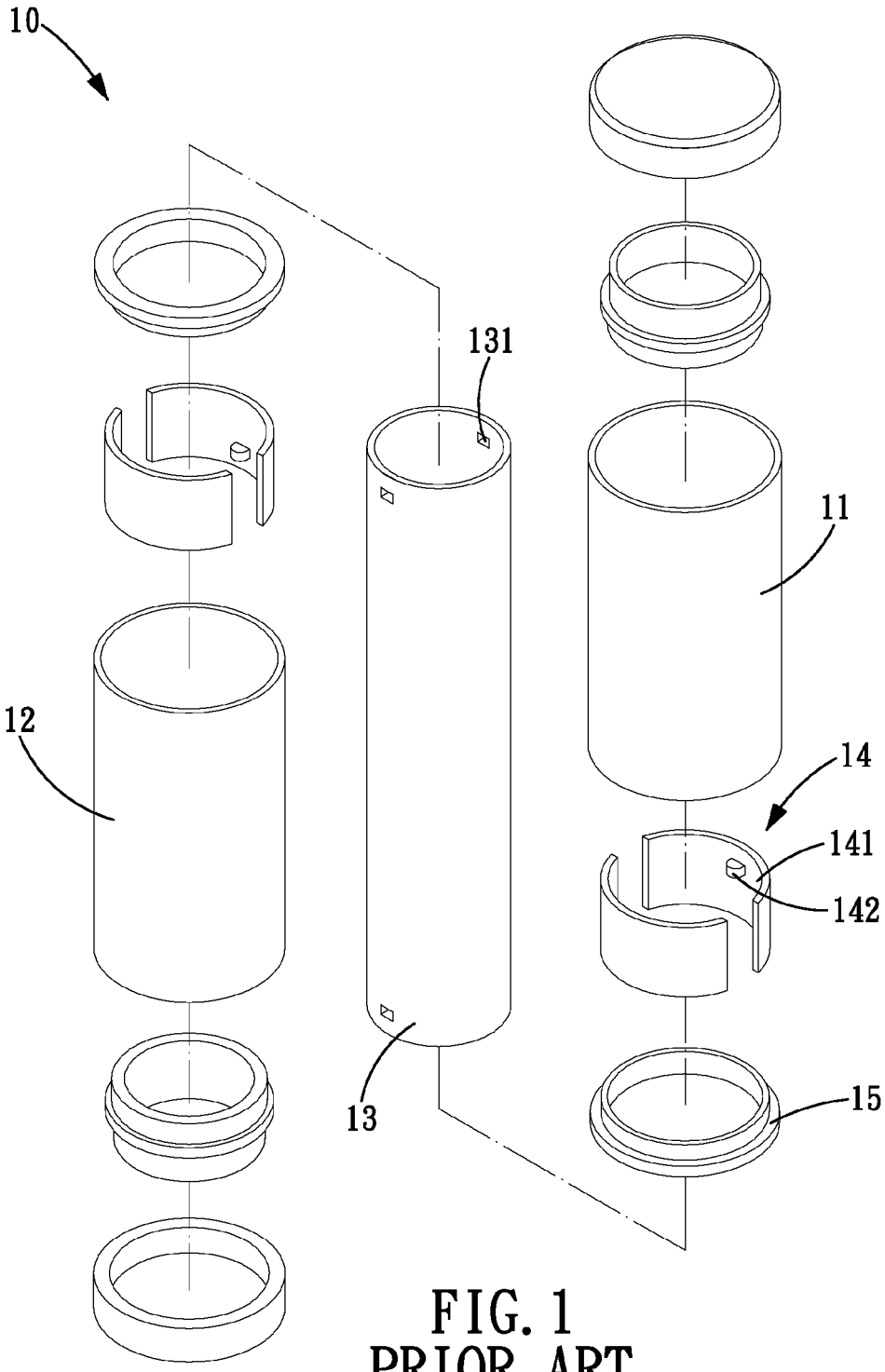
FIG. 1 PRIOR ART
FIG. 1 is an exploded view of a conventional cigar holder
Figure 2:
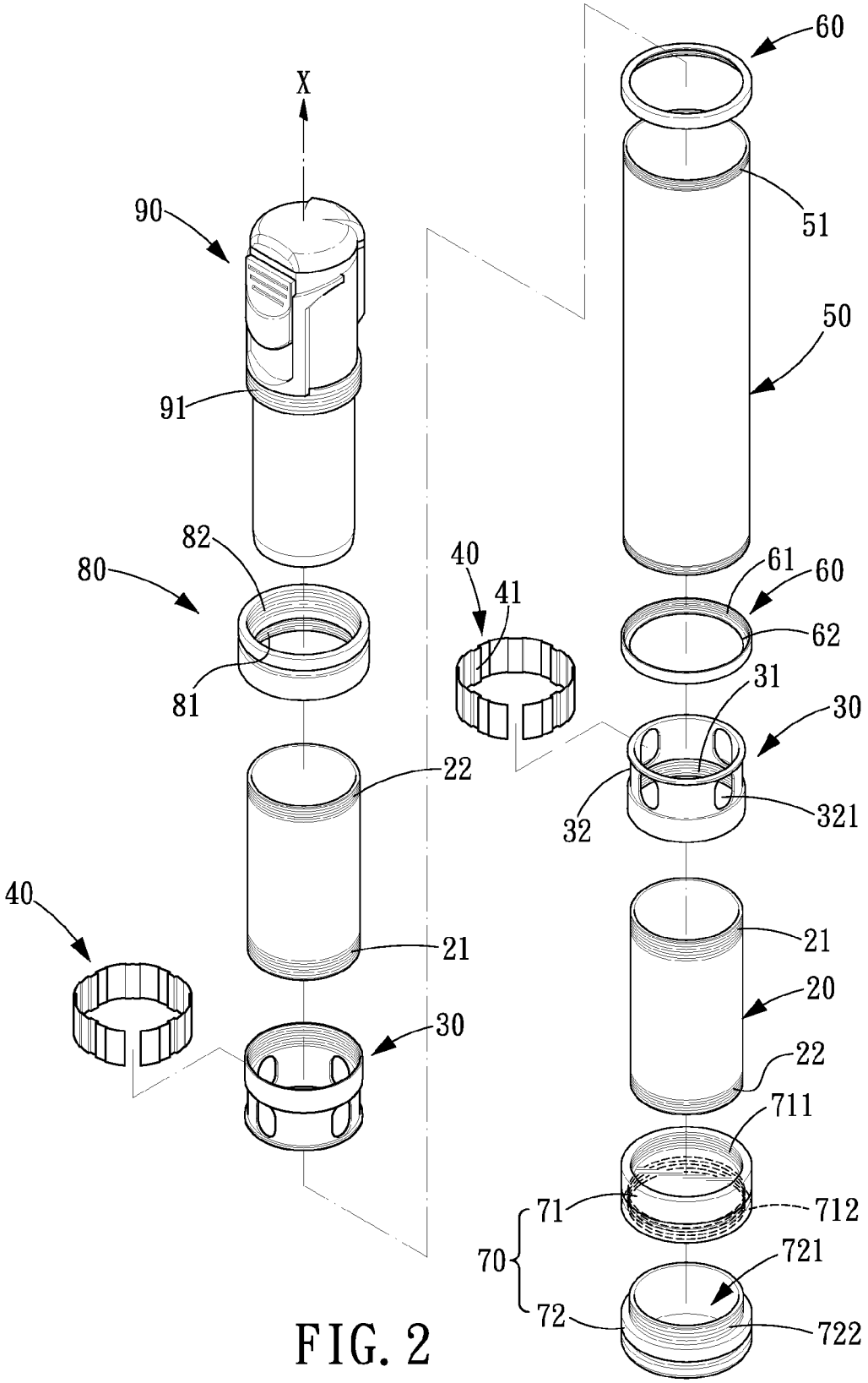
FIG. 2 is an exploded view of a bi-directional multiple-layer pull-in cigar holder in accordance with the present invention.
Figure 3:
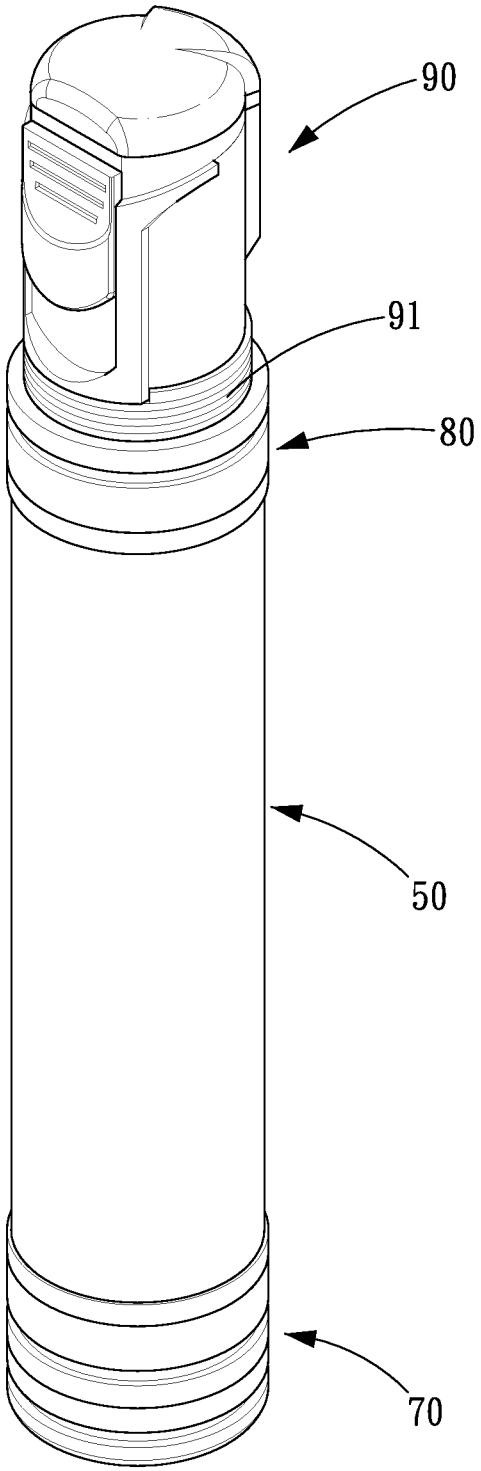
FIG. 3 is an assembly view of the bi-directional multiple-layer pull-in cigar holder in accordance with the present invention.
Figure 4:
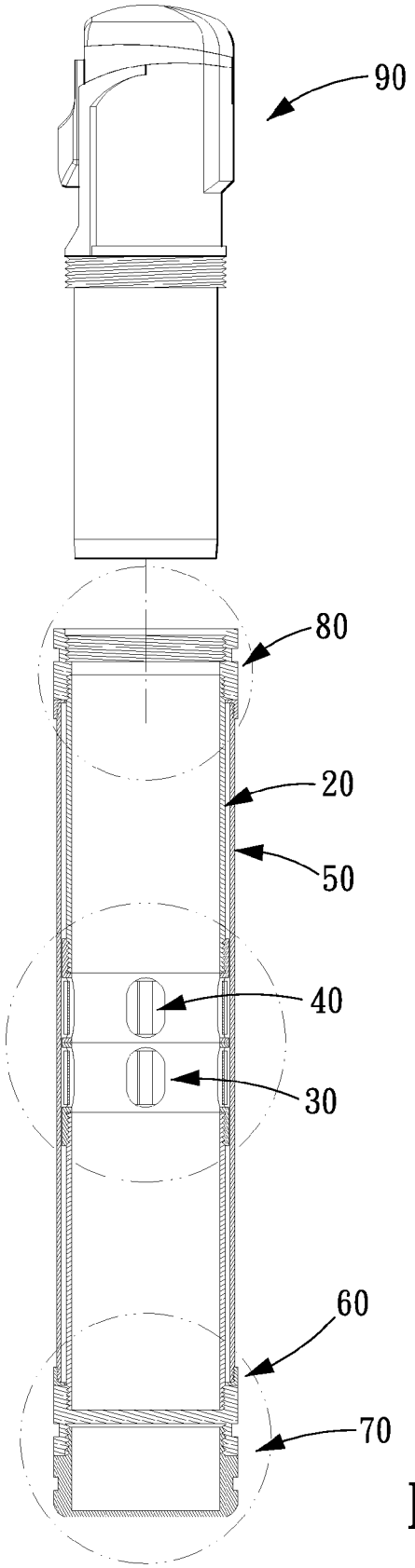
FIG. 4 is a cross-sectional view showing that the lighter is disassembled from the bi-directional multiple-layer pull-in cigar holder in accordance with the present invention.
Figure 5:
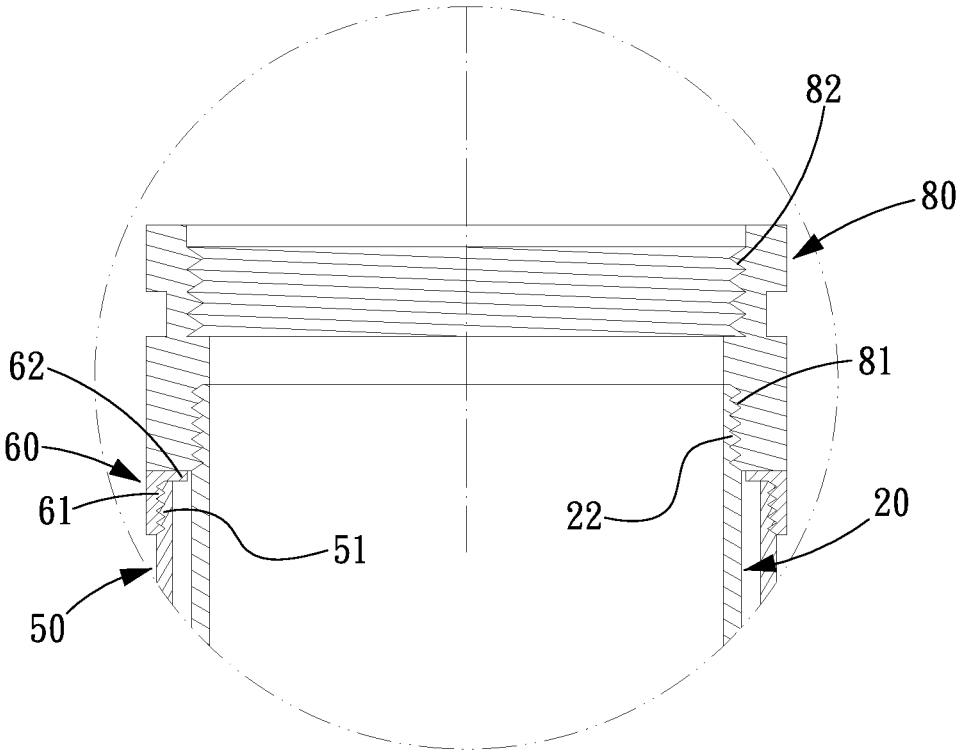
FIG. 5 is a partial enlarged view of FIG. 4.
Figure 6:
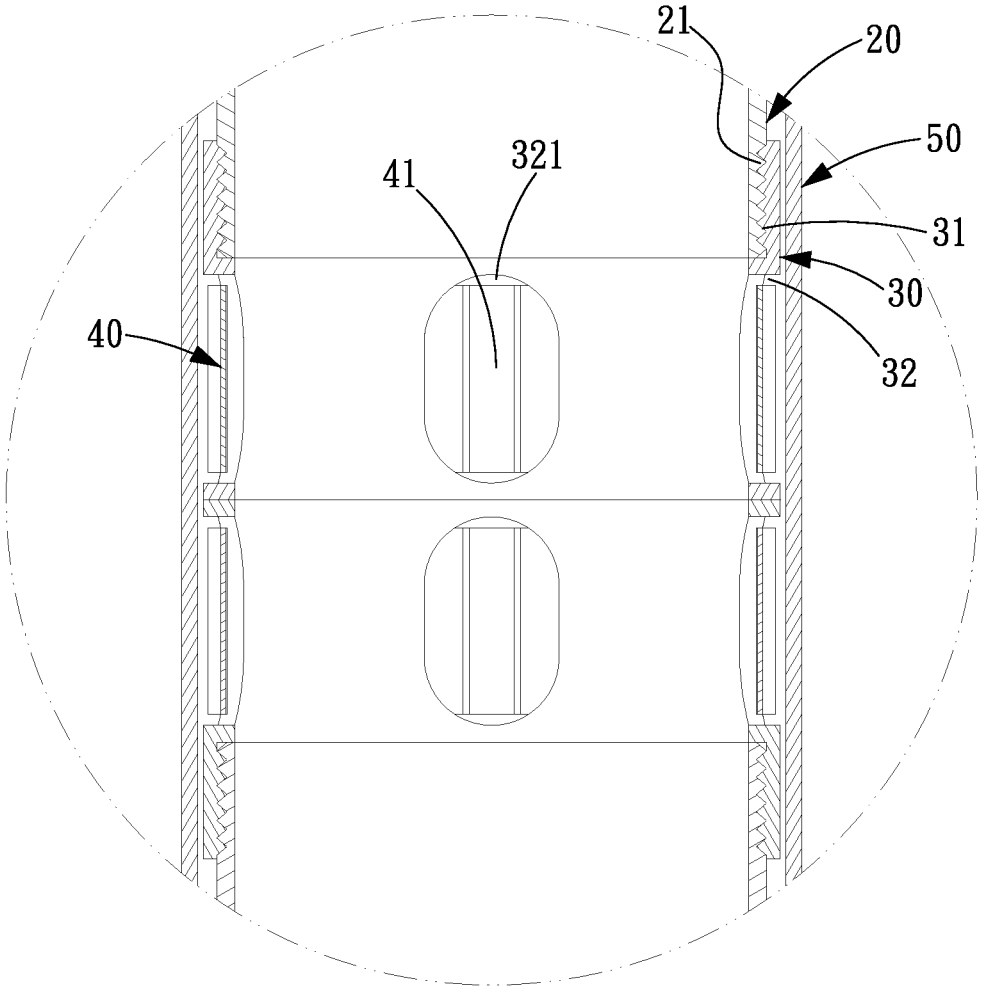
FIG. 6 is another partial enlarged view of FIG. 4.
Figure 7:
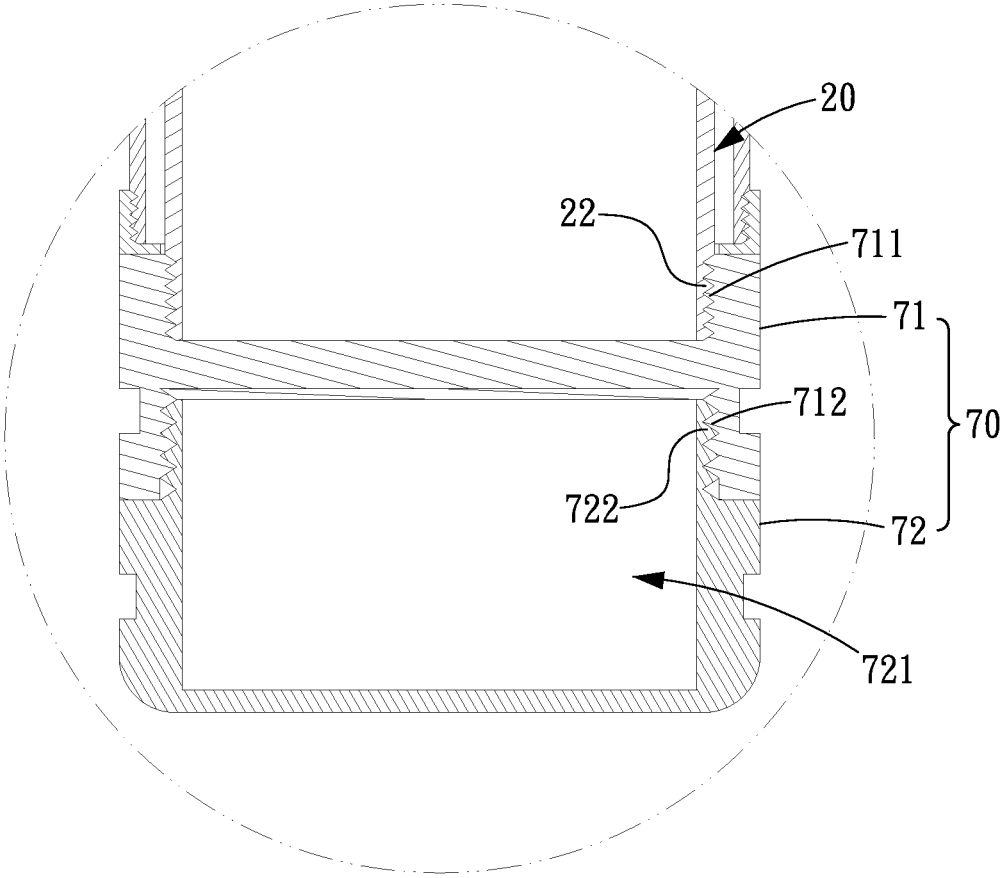
FIG. 7 is another partial enlarged view of FIG. 4.
Figure 8:
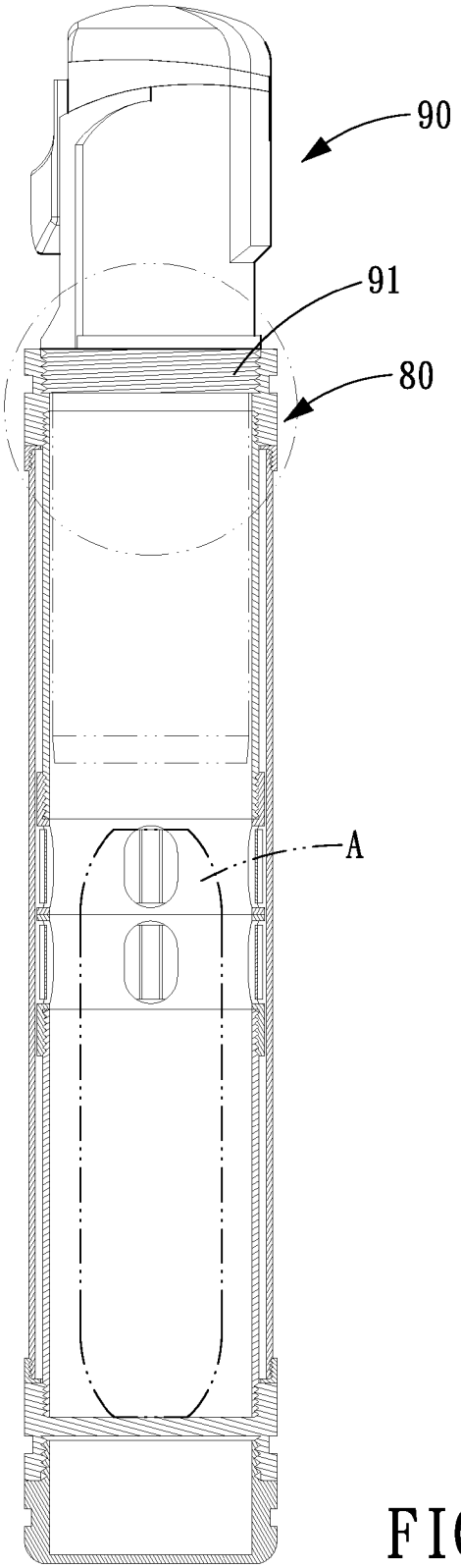
FIG. 8 is a cross-sectional view showing the lighter is assembled on the bi-directional multiple-layer pull-in cigar holder in accordance with the present invention.
Figure 9:
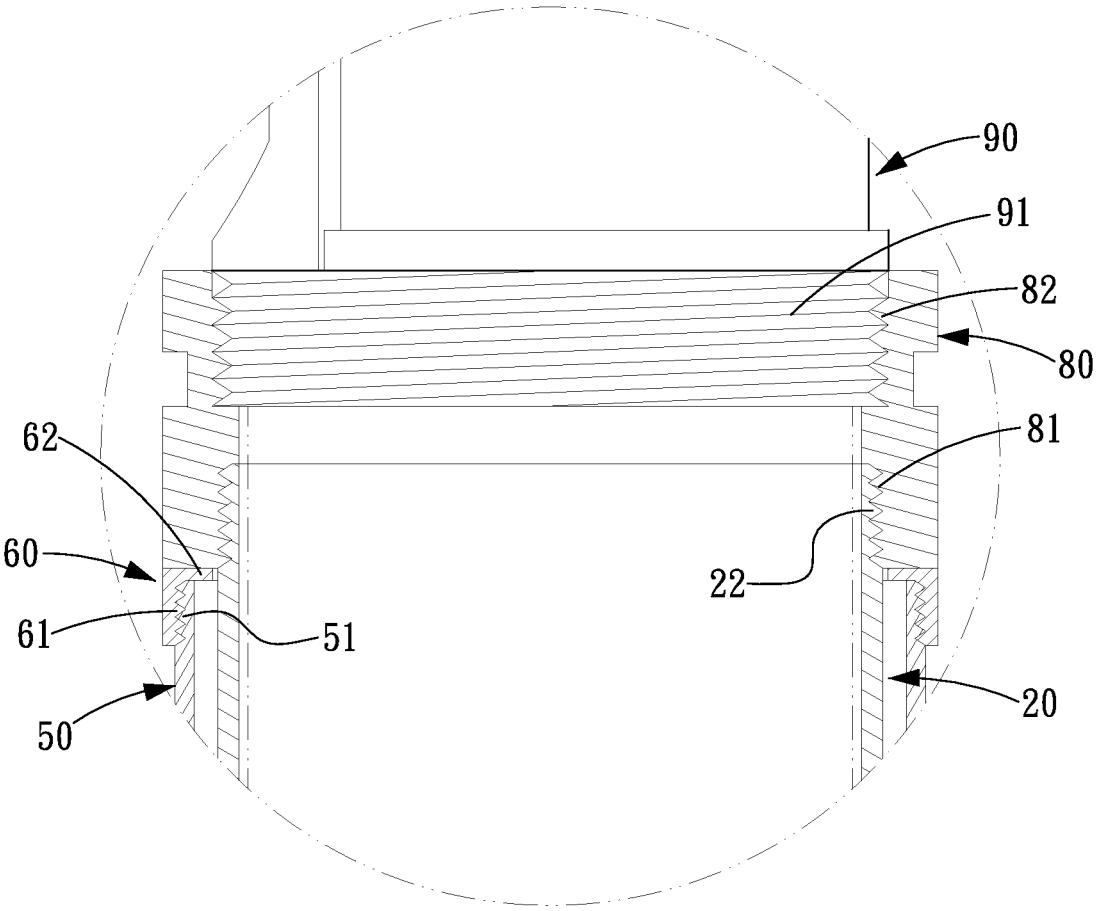
FIG. 9 is a partial enlarged view of FIG. 8.

The present invention will be clearer from the following description when viewed together with the accompanying drawings, which show, for purpose of illustrations only, the preferred embodiment in accordance with the present invention.

Referring to FIGS. 1-9, a bi-directional multiple-layer pull-in cigar holder in accordance with a preferred embodiment of the present invention comprises two extension tubes 20, at least two circular bases 30, at least two elastic retaining rings 40, a receiving body 50, two end cap rings 60, a bottom storage unit 70, a medium connecting element 80, and a lighter 90.

Each of the two extension tubes 20 is formed with a first outer threaded portion 21 and a second outer threaded portion 22 on two opposite ends thereof.

In the present embodiment, the cigar holder comprises two circular bases 30, and each of the circular bases 30 is formed in a first end thereof with an inner threaded portion 31 to be screwed on the first outer threaded portion 21 of the respective extension tubes 20, and a second end of each of the circular bases 30 is formed with a ring groove 32 in an outer surface thereof. Each of the ring grooves 32 is formed with plural through holes 321. The circular bases 30 are connected to the respective extension tubes 20 by screwing the first outer threaded portions 21 in the inner threaded portions 31.

In the present embodiment, the cigar holder in accordance with the present invention comprises two elastic retaining rings 40 which are C-shaped elastic plates. Each of the elastic retaining rings 40 includes plural protruding portions 41 on an inner surface thereof. The elastic retaining rings 40 are received in the respective ring grooves 32 of the circular bases 30 in such a manner that the protruding portions 41 of the elastic retaining rings 40 are engaged in the through holes 321 of the ring grooves 32.

The receiving body 50 is in the form of a hollow tube and provided with an outer threaded portion 51 on each of two opposite ends thereof. An extending direction of the receiving body 50 is defined as an axial direction X. The two extension tubes 20 are received in the receiving body 50. The two circular bases 30 are located adjacent to each other, and the second outer threaded portions 22 of the two extension tubes 20 extend out of the two opposite ends of the receiving body 50.

The two end cap rings 60 each include an inner threaded portion 61 on an inner surface of a first end thereof, and a second end of each of the two end cap rings 60 is formed with an inwards-protruding stopping flange 62. The respective end cap rings 60 are mounted on a second end of the respective extension tubes 20 which extends out of the receiving body 50 in such a manner that the inner threaded portions 61 are screwed on the outer threaded portions 51. The respective stopping flanges 62 extend in the receiving body 50.

The bottom storage unit 70 includes a bottom cover 71 and a bottom storage element 72. The bottom cover 71 is formed with a first inner threaded portion 711 and a second inner threaded portion 712 in both ends thereof. One of the inner threaded portions 711, 712 is screwed to the second outer threaded portion of one of the extension tubes 20, and in the present embodiment, the first inner threaded portion 711 of the bottom cover 71 is screwed on the second outer threaded portion 22 of one of the extension tubes 20. The bottom storage element 72 has an open end and includes a storage space 721. The bottom storage element 72 includes an outer threaded portion 722 on the open end thereof. The bottom storage element 72 is screwed to the second inner threaded portion 712 of the bottom cover 71 through the outer threaded portion 722.

The medium connecting element 80 is in the form of a ring and includes a first inner threaded portion 81 and a second inner threaded portion 82 on both ends thereof. The medium connecting element 80 is screwed on the second outer threaded portion 22 of the other extension tube 20 through the first inner threaded portion 81, and the second inner threaded portion 82 is screwed on the outer threaded portion 722 of the bottom storage element 72.

The lighter 90 includes an outer threaded portion 91 on an outer surface thereof. The lighter 90 is screwed into the inner threaded portion 82 of the medium connecting element 80 through the outer threaded portion 91.

The aforementioned is the summary of the positional and structural relationship of the respective components of the preferred embodiment in accordance with the present invention.

Figure 10:
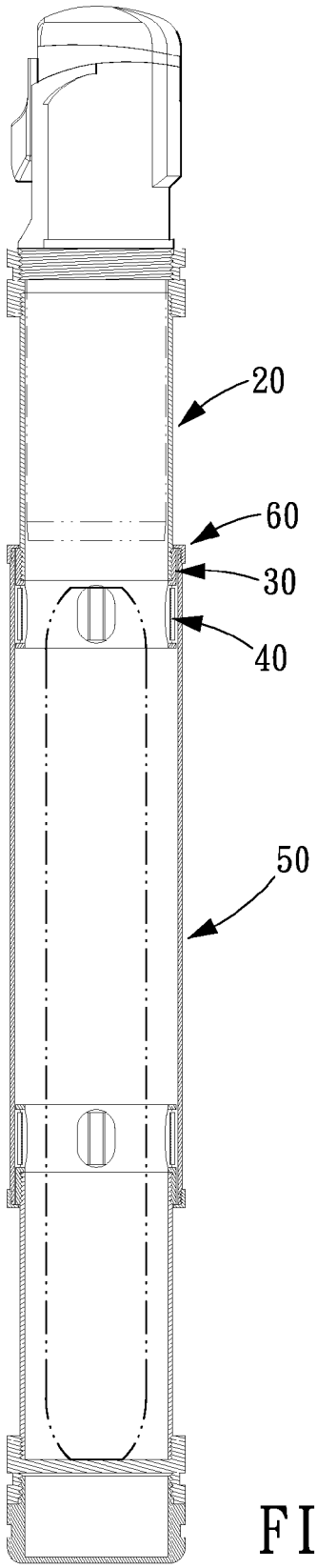
FIG. 10 is a cross-sectional view showing the extending state of the bi-directional multiple-layer pull-in cigar holder in accordance with the present invention.

After the assembly of the above respective components is finished, the respective extension tubes 20 in the receiving body 50 can be used to hold and store the cigar A, and the lighter 90 and the bottom storage unit 70 seal the second ends of the respective extension tubes 20. The lighter 90 can be taken out when necessary, and when the lighter 90 is taken out, an end of the receiving body 50 is opened to allow the user to take out or put in the cigar A. When the length of the cigar A is greater than a length of the receiving body 50 in the axial direction X, the user can pull the medium connecting element 80 or the bottom storage unit 70 which is screwed to the respective extension tubes 20, so that the two extension tubes 20 can move away from each other to extend the length of the cigar holder in accordance with the present invention for holding longer cigar A, as shown in FIG. 10. As known from this, the bi-directional multiple-layer pull-in cigar holder in accordance with the present invention can be adjusted in length by the user, improving its applicability. Since the bi-directional multiple-layer pull-in cigar holder in accordance with the present invention is assembled with the lighter 90, the user doesn't need to additionally carry a lighter, improving the use convenience.

To assemble the respective extension tubes 20, the respective elastic retaining rings 40 will be compressed first, so that the extension tubes 20 can be disposed in the receiving body 50. When the respective extension tubes 20 are received in the receiving body 50, the elastic retaining rings 40 will elastically abut against the inner surface of the receiving body 50 due to the fact that the respective elastic retaining rings 40 are fastened on the circular bases 30, as a result of this, the respective elastic retaining rings 40 can offer a displacement resistance with respect to the receiving body 50, synchronously avoiding the disengagement of the respective extension tubes 20.

Since the elastic retaining rings 40 are C-shaped big-area plates, they can improve the convenience in assembly while offering a more stable resistance, thus ensuring a high operation stability of the cigar holder in accordance with the present invention.

Figure 11:
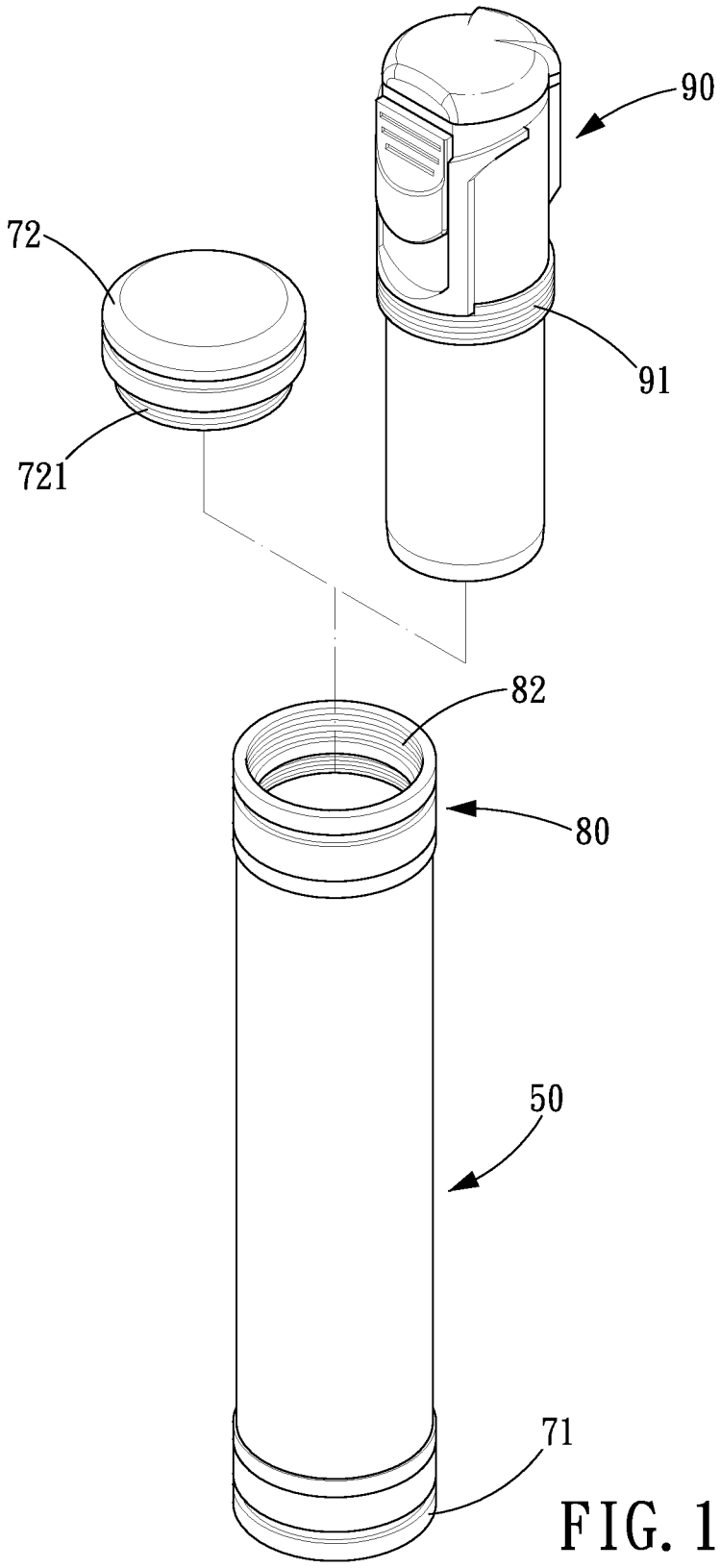
FIG. 11 is a perspective view showing another implementation state of the bi-directional multiple-layer pull-in cigar holder in accordance with the present invention.
Figure 12:
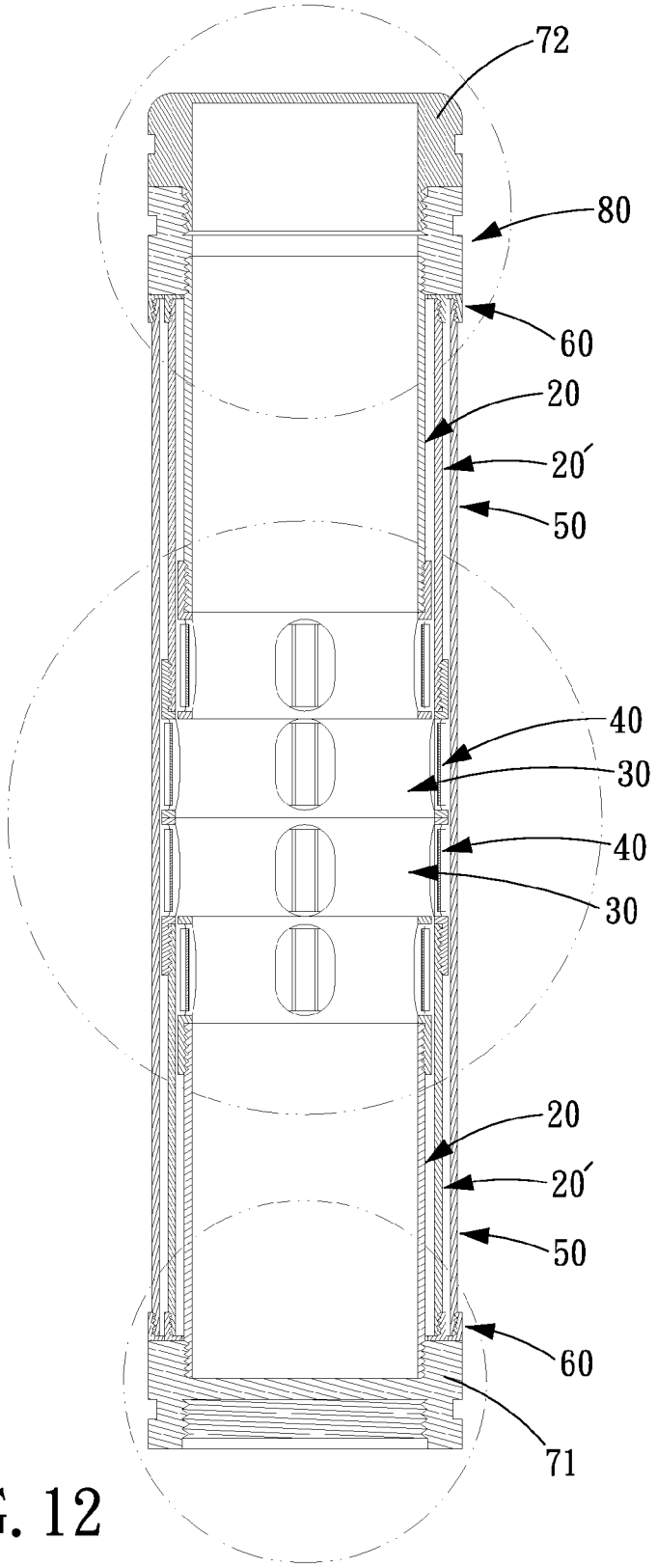
FIG. 12 is another bi-directional multiple-layer pull-in cigar holder in accordance with the present invention.
Figure 13:
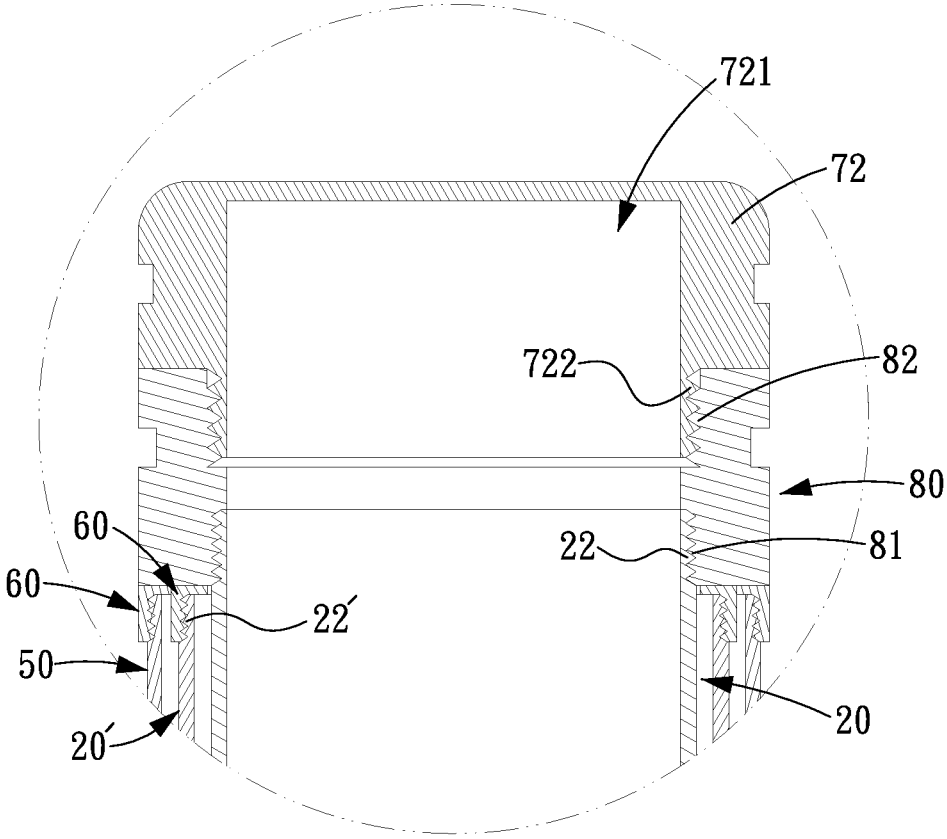
FIG. 13 is a partial enlarged view of FIG. 12.
Figure 14:
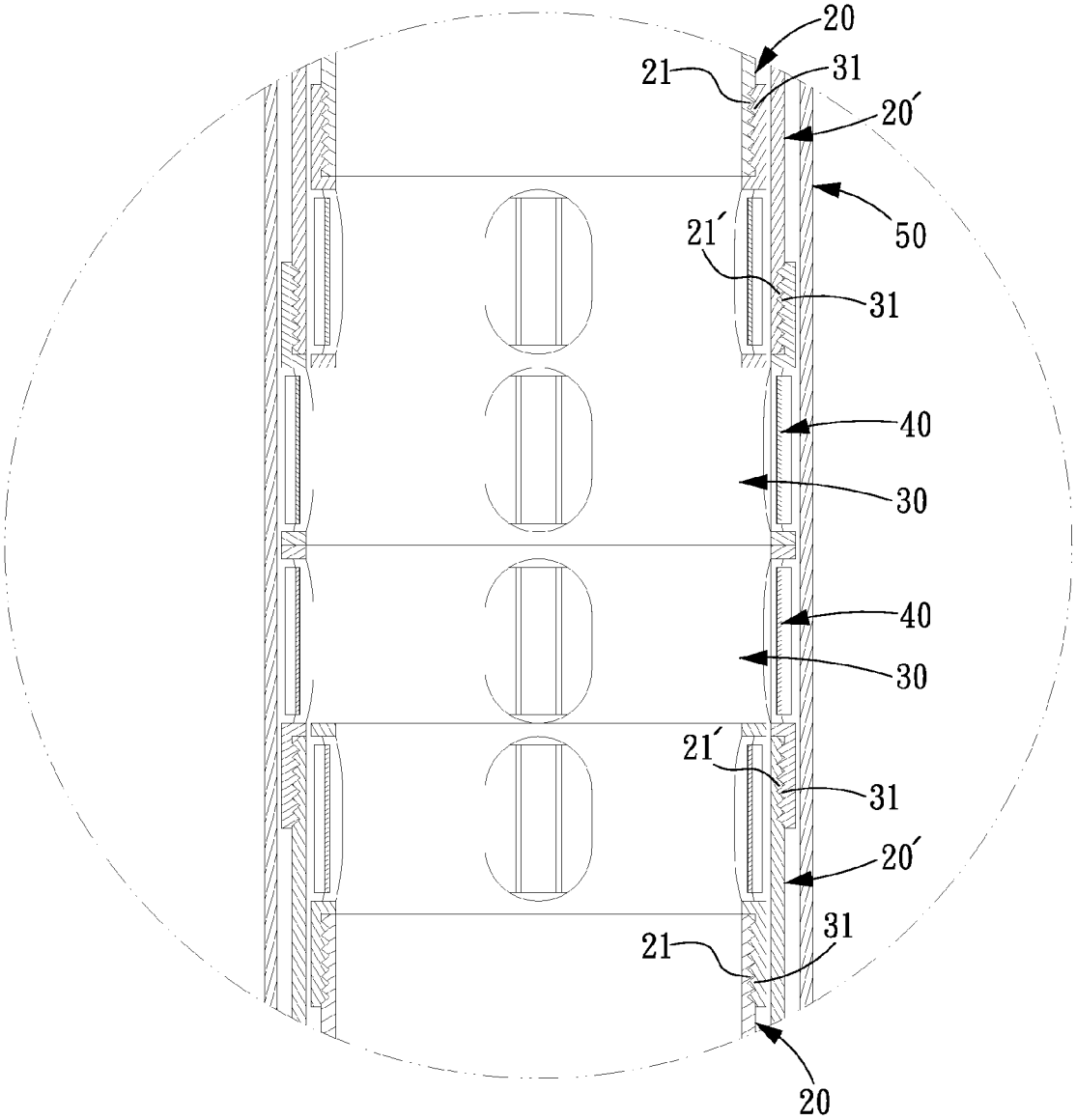
FIG. 14 is another partial enlarged view of FIG. 12.
Figure 15:
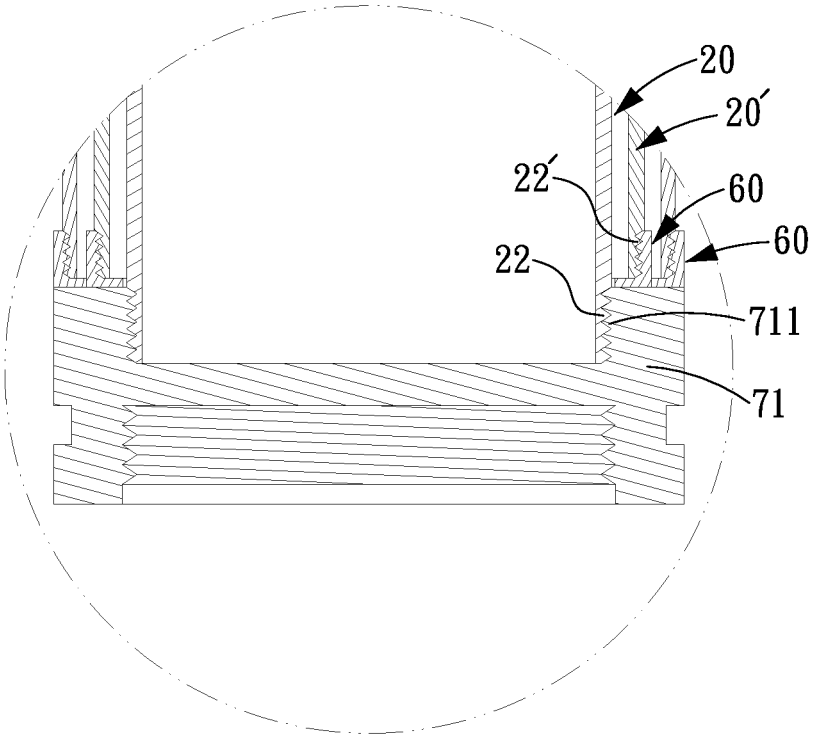
FIG. 15 is another partial enlarged view of FIG. 12.

Further, as shown in FIG. 11, the lighter 90 can be disassembled for use. After the lighter 90 is disassembled, the bottom storage element 72 of the storage unit 70 can be disassembled from the bottom cover 71 and screwed to the second inner threaded portion 82 of the medium connecting element 80 through the outer threaded portion 722, so that the bottom cover 71 and the bottom storage element 72 of the bottom storage unit 70 can seal both ends of the cigar holder in accordance with the present invention.

Furthermore, as shown in FIGS. 12-15, in another embodiment, the cigar holder in accordance with the present invention can be further provided with an adjusting extension tubes 20' outside each of the extension tubes 20. The adjusting extension tubes 20' are in structure similar to the extension tubes 20. Each of the adjusting extension tubes 20' includes a first outer threaded portion 21' and a second outer threaded portion 22' on both ends thereof. The first outer threaded portion 21' of each of the adjusting extension tube 20' is screwed to one circular base 30, and each of the circular bases 30 is also screwed with one elastic retaining ring 40. The second outer threaded portion 22' of each of the respective adjusting extension tubes 20' is also screwed with one end cap ring 60. The extension tubes 20 which are engaged to the respective adjusting extension tubes 20' are located at the same end of the respective adjusting extension tubes 20' as the respective circular bases 30, and the receiving body 50 is mounted outside the respective extension tubes 20 and the respective adjusting extension tubes 20' with the respective circular bases 30 being located adjacent to each other. By such arrangements, it can form a three-layer extension structure, increasing the extension length of the present invention while further improving the applicability of the present invention.

Figure 16:
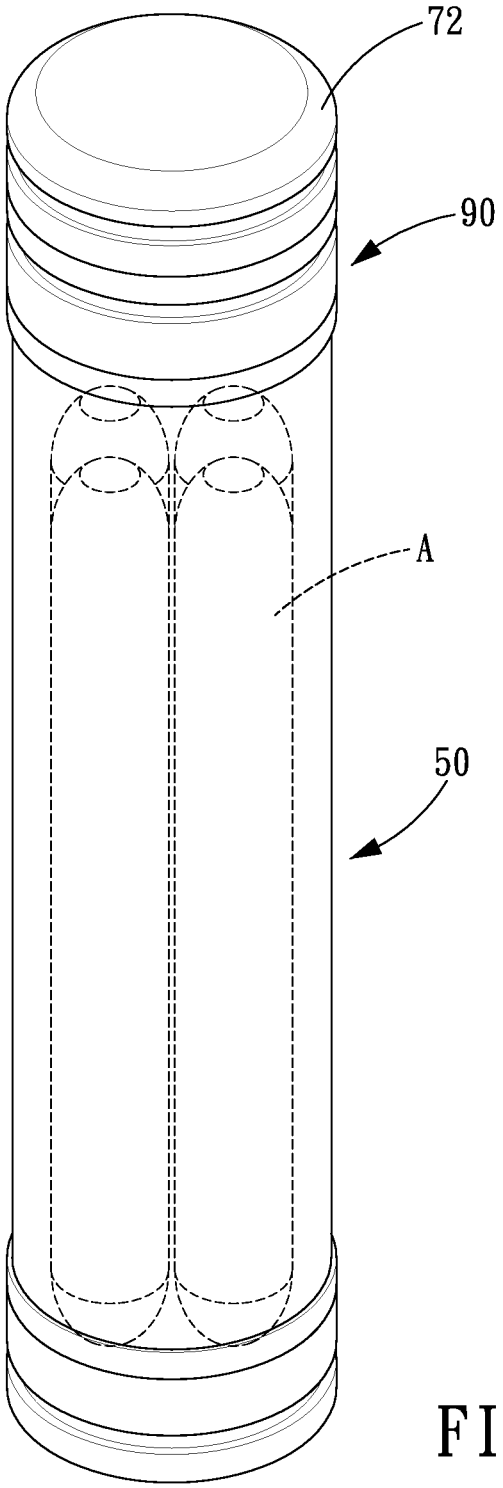
FIG. 16 is a perspective view showing the respective components of the bi-directional multiple-layer pull-in cigar holder in accordance with the present invention are increased in diameter.

Moreover, as shown in FIG. 16, the respective components of the present invention can be increased in diameter such that the cigar holder in accordance with the present invention can hold much more cigars A, further increasing the applicability of the present invention.

While we have shown and described various embodiments in accordance with the present invention, it is clear to those skilled in the art that further embodiments may be made without departing from the scope of the present invention.

What is claimed is:

1. A bi-directional multiple-layer pull-in cigar holder comprising:

two extension tubes;

at least two circular bases, a first end of each of the two circular bases being connected to a first end of each of the two circular bases, and a second end of each of the two circular bases being formed with ring grooves having plural through holes;

at least two elastic retaining rings being C-shaped elastic plates, each of the elastic retaining rings including plural protruding portions on an inner surface thereof, the elastic retaining rings being disposed on the respective circular bases, the protruding portions of the elastic retaining rings being engaged in the through holes of the ring grooves;

a receiving body being in the form of a hollow tube, the two extension tubes being received in the receiving body, the two circular bases being located adjacent to each other, a second end of each of the extension tubes extending out of each of two opposite ends of the receiving body;

a bottom storage unit being screwed to the second end of a first one of the extension tubes;

a medium connecting element being in the form of a ring and including a first inner threaded portion and a second inner threaded portion on both ends thereof, the medium connecting element being screwed on a second one of the two extension tubes through the first inner threaded portion; and a lighter including an outer threaded portion on an outer surface thereof, the lighter being screwed into the inner threaded portion of the medium connecting element through the outer threaded portion.

2. The bi-directional multiple-layer pull-in cigar holder as claimed in claim 1, wherein each of the extension tubes is formed with a first outer threaded portion and a second outer threaded portion on both ends thereof, each of the circular bases includes an inner threaded portion correspondingly to the first outer threaded portion of the extension tube, the respective extension tubes are screwed to the inner threaded portions of the respective circular bases through their inner threaded portions.

3. The bi-directional multiple-layer pull-in cigar holder as claimed in claim 1 further comprising two end cap rings, each of the two end cap rings includes an inner threaded portion on an inner surface of a first end thereof, and a second end of each of the two end cap rings is formed with an inwards-protruding stopping flange, the respective end cap rings are mounted on the second ends of the respective extension tubes, the receiving being formed with an outer threaded portion on each of two opposite ends thereof, the respective stopping flanges extend in the receiving body.

4. The bi-directional multiple-layer pull-in cigar holder as claimed in claim 1, wherein the number of the circular bases is two, and the number of the elastic retaining rings is two.

5. The bi-directional multiple-layer pull-in cigar holder as claimed in claim 1, wherein each of the circular bases includes a ring groove on an inner surface thereof, and the through holes of respective are formed in the respective ring grooves.

6. The bi-directional multiple-layer pull-in cigar holder as claimed in claim 1, wherein each of the extension tubes is formed with a first outer threaded portion and a second outer threaded portion on both ends thereof, each of the circular bases includes an inner threaded portion correspondingly to the first outer threaded portion of the extension tube, the respective extension tubes are screwed to the inner threaded portions of the respective circular bases through their inner threaded portions, the bottom storage unit includes a bottom cover, the bottom cover is formed with a first inner threaded portion on a first end thereof, the bottom cover is screwed on the second outer threaded portion of the second one of the two extension tubes through the first inner threaded portion thereof.

7. The bi-directional multiple-layer pull-in cigar holder as claimed in claim 6 further comprising a bottom storage element, the bottom storage element having an open end and including a storage space, the bottom storage element including an outer threaded portion on the open end thereof, the bottom cover being formed with a second inner threaded portion on a second end thereof, the bottom storage unit being screwed to the second inner threaded portion of the bottom cover through the outer threaded portion thereof, the outer threaded portion of the bottom storage element being selectively screwed to the second inner threaded portion of the medium connecting element.

8. The bi-directional multiple-layer pull-in cigar holder as claimed in claim 1 further comprising two adjusting extension tubes, two circular bases, two elastic retaining rings and two end cap rings, each of the extension tubes being engaged with one the adjusting extension tube, each of the adjusting extension tubes including a first outer threaded portion and a second outer threaded portion on both ends thereof, the first outer threaded portion of each of the adjusting extension tubes being screwed with another circular base which being used together with another elastic retaining ring, the second outer threaded portion of each of the adjusting extension tubes being screwed with the respective end cap rings, the extension tubes which are engaged to the respective adjusting extension tubes being located at the same end of the respective adjusting extension tubes as the respective circular bases, the receiving body being mounted outside the respective extension tubes and the respective adjusting extension tubes with the circular bases being located adjacent to each other.

* * * * *